US008540288B2

(12) United States Patent
Tsai

(10) Patent No.: US 8,540,288 B2
(45) Date of Patent: Sep. 24, 2013

(54) DOOR LOCK TRANSMISSION STRUCTURE

(76) Inventor: Miao-Hsueh Tsai, Taichung (TW)

( * ) Notice: Subject to any disclaimer, the term of this patent is extended or adjusted under 35 U.S.C. 154(b) by 348 days.

(21) Appl. No.: 12/874,186

(22) Filed: Sep. 1, 2010

(65) Prior Publication Data

US 2011/0062728 A1 Mar. 17, 2011

(30) Foreign Application Priority Data

Sep. 14, 2009 (TW) ..... 98216939 U

(51) Int. Cl.
*E05C 5/00* (2006.01)

(52) U.S. Cl.
USPC ..... 292/24; 292/64; 292/336.3; 292/DIG. 53

(58) Field of Classification Search
USPC ..... 292/DIG. 46, 24, 26, 22, 56, 39, 292/51, 112, 116; 70/95
See application file for complete search history.

(56) References Cited

U.S. PATENT DOCUMENTS

| | | | | |
|---|---|---|---|---|
| 7,856,857 | B2 * | 12/2010 | Tsai | 70/107 |
| 8,061,166 | B2 * | 11/2011 | Tsai | 70/107 |
| 2002/0104339 | A1 * | 8/2002 | Saner | 70/108 |
| 2004/0107746 | A1 * | 6/2004 | Chang | 70/107 |
| 2005/0166647 | A1 * | 8/2005 | Walls et al. | 70/107 |

* cited by examiner

*Primary Examiner* — Kristina Fulton
(74) *Attorney, Agent, or Firm* — Wang Law Firm, Inc.; Li K. Wang; Stephen Hsu

(57) ABSTRACT

A door lock transmission structure includes two inserts and a link component installed in a case, and the two inserts are driven by a key and a door handle respectively. The insert driven by the door handle includes two driving elements for driving one of the inserts to operate, such that the two inserts are driven for a synchronous operation when one of the driving elements is operated, so as to constitute the door lock transmission structure.

9 Claims, 9 Drawing Sheets

DOOR LOCK TRANSMISSION STRUCTURE

BACKGROUND OF THE INVENTION

1. Field of the Invention

The present invention relates to a door lock, and more particularly to a door lock structure driven by a primary lock assembly and a secondary lock assembly for its operation.

2. Description of the Related Art

With reference to FIGS. 8 and 9 for a conventional door lock, the door lock comprises a case 90, and a first insert 91 and a second insert 92, both installed in the case 90, wherein the first insert 91 drives a link rod module 93 by a key to slide inside the case 90 and link both upper and lower locks of a door, and the second insert 92 is driven by a door handle to move a driving element 94 and link the driving element 94 to slide in the case 90, and the first insert 91 and the second insert 92 as shown in the figures are driven by the key and the door handle respectively.

The main problem of the conventional door lock resides on that when both first insert 91 and second insert 92 are locked (and their locked status is shown in FIG. 8), and if the door is opened from inside, then users behind the door have to open the first insert 91 first, and then turn the door handle connected to the second insert 92 before the door can be opened (and the unlocked status is shown in FIG. 9), and thus it takes two steps to open a door, and the conventional door lock definitely requires improvements to give a more convenient way of opening the door. If there is a fire, and users have to escape for their survival, such conventional door lock may delay the escape, and thus the conventional door lock requires improvements on safety.

SUMMARY OF THE INVENTION

Therefore, it is a primary objective of the present invention to overcome the aforementioned shortcomings of the prior art by providing a door lock transmission structure, wherein a second insert of a primary lock assembly can be opened by turning a door handle installed on an internal side of a door directly, and the second insert is driven to open a first insert and a secondary lock assembly, such that the door can be opened conveniently at regular time, and quickly at fire or any other emergency situation to provide a safe escape.

Another objective of the present invention is to provide a power-saving mechanism installed between components of the primary lock assembly to provide a power-saving way of locking and unlocking the door.

To achieve the foregoing objective, the present invention provides a door lock transmission structure, comprising:

a case, having a plurality of protruding pillars and through holes, disposed in the case for installing a primary lock assembly, and the primary lock assembly driving a secondary lock assembly by link rods installed at upper and lower positions of a door, and the primary lock assembly comprising:

a first insert and a second insert, both movably installed in the case, and each having a latch portion disposed at an end of the insert and passing out of the case, a swaying element installed in the case and moving the first insert to slide, and a stop wall disposed at an end of the second insert inside the case;

two driving elements, driven by a door handle, and stacked with each other in the case and driven independently, and having a coupling portion installed coaxially between both ends of the two driving elements for installing the door handle, and each coupling position driving an insert hole, and a first turning end disposed on the same side of the end of the driving element for driving the second insert to slide, wherein another end of the door handle on the internal side of the door and connected to the driving element includes a second turning end for linking and operating the first insert;

a plate, linked with the first insert and the two secondary lock assemblies for a synchronous operation, and both ends of the plate being coupled to a link rod between the two secondary lock assemblies, and a first link element slid together with the first insert to pivotally swing and drive the plate to move;

a second link element, operated together with the driving element to drive the second insert to slide, and having a first abutting portion disposed on an internal side of the second link element, and abutted against an internal side of a stop wall of the second insert, and a second abutting portion abutted against the first turning end of the two driving elements; and a link component, linked with the first insert and the second insert for a synchronous operation, and including a sliding element linked between both ends of the link component and with the second turning end of the driving element, a spring installed at an end of the sliding element; and resuming its original position after the sliding element is moved, and another end of the spring being coupled to swaying element for linking the latch portion for retracting the first insert, and a poking portion disposed at an end of the link component for driving the swaying element to sway.

The foregoing and other objectives and advantages of the present invention will become apparent with the detailed description of preferred embodiments and related drawings as follows.

Of course, another element and/or an arrangement of elements of the present invention may be altered or modified in an equivalent manner, and the invention is not limited to the preferred embodiments and drawings used in this specification only.

DETAILED DESCRIPTION OF THE PREFERRED EMBODIMENTS

Figure 1:
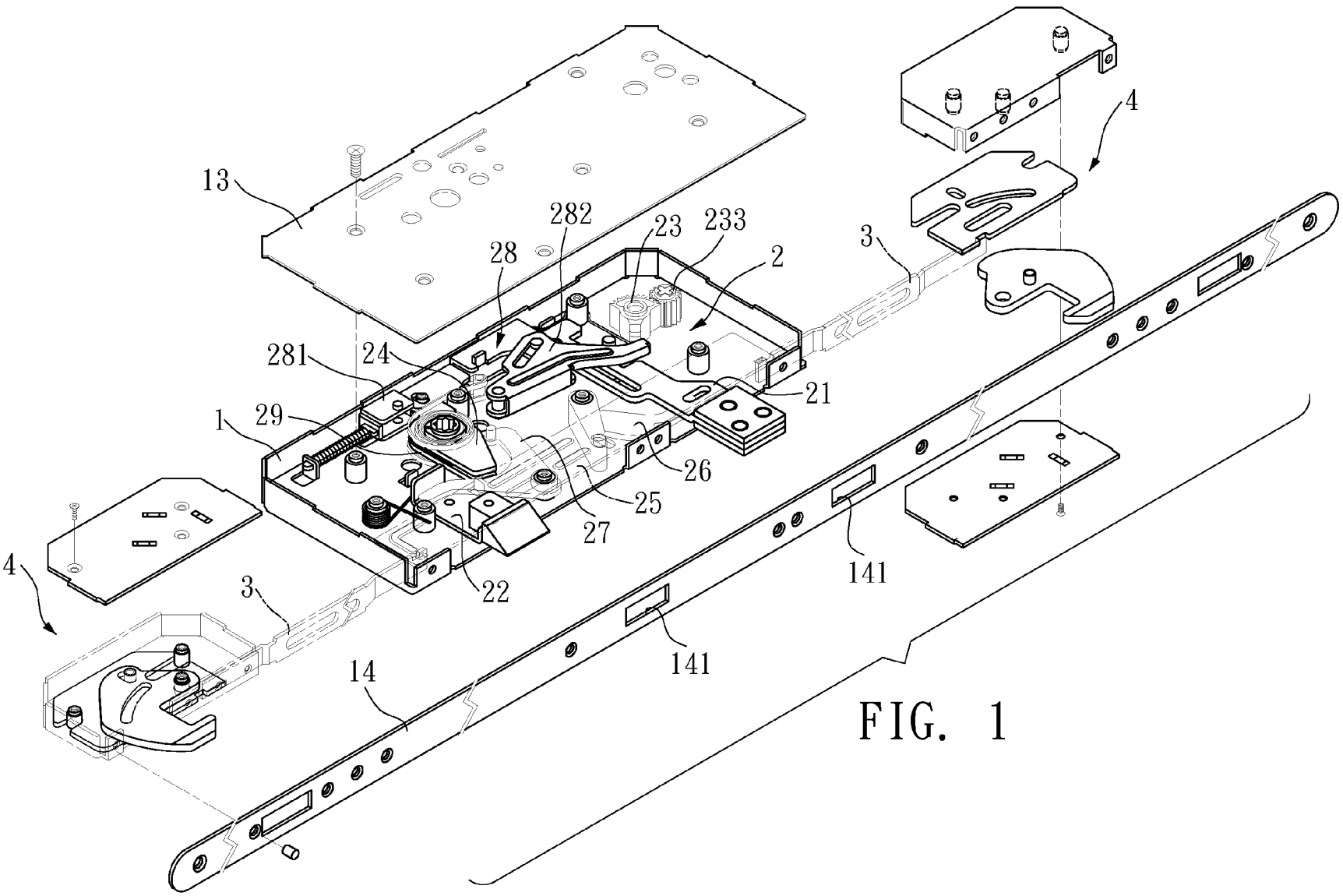
FIG. 1 is a perspective view of a door lock of the present invention.
Figure 2:
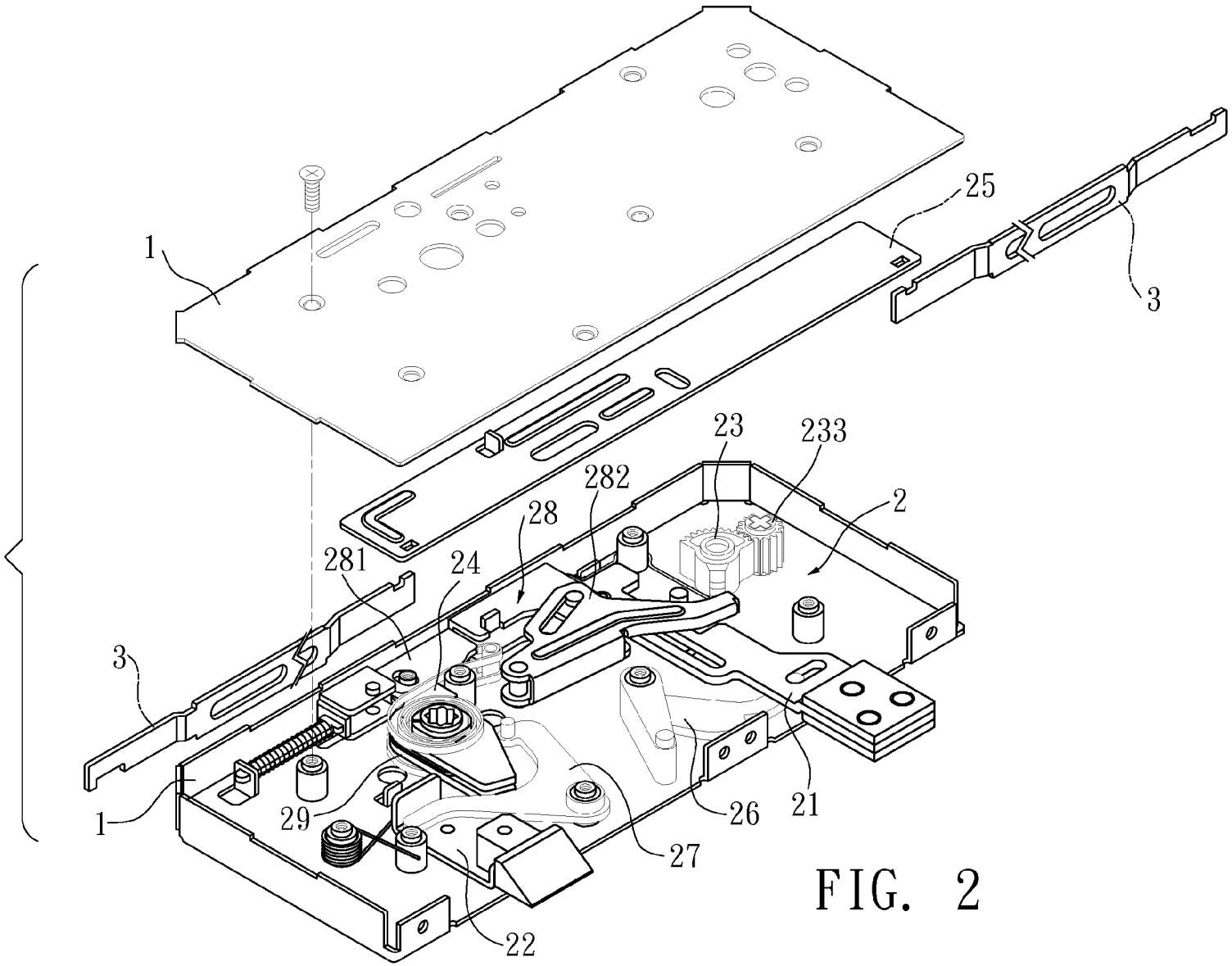
FIG. 2 is a perspective view of a primary lock assembly of the present invention.
Figure 3:
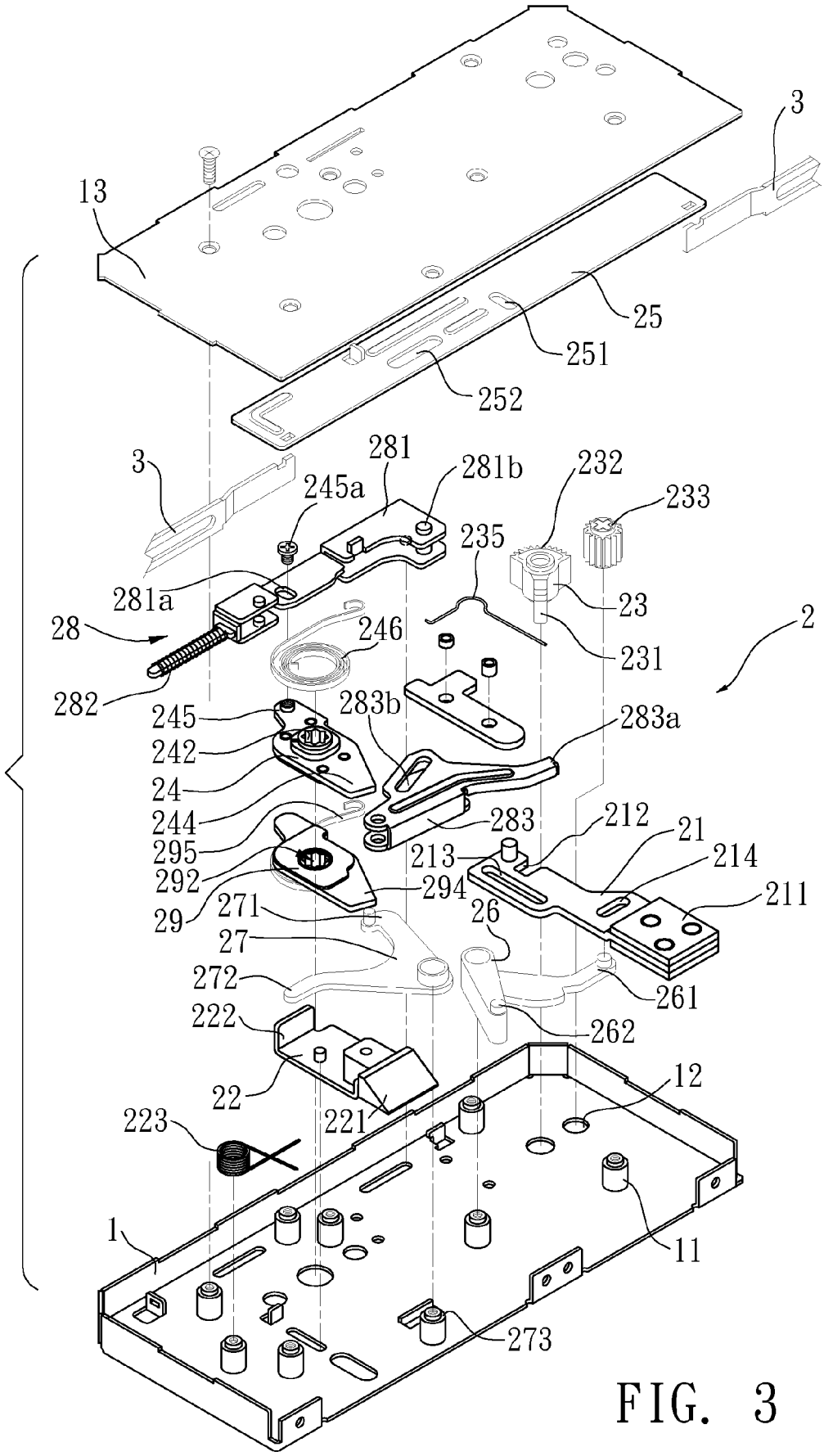
FIG. 3 is an exploded view of a primary lock assembly of the present invention.

With reference to FIGS. 1 to 7 for a preferred embodiment of the present invention, this embodiment is provided for the purpose of illustrating the present invention only, but not intended for limiting the scope of the invention.

Figure 4:
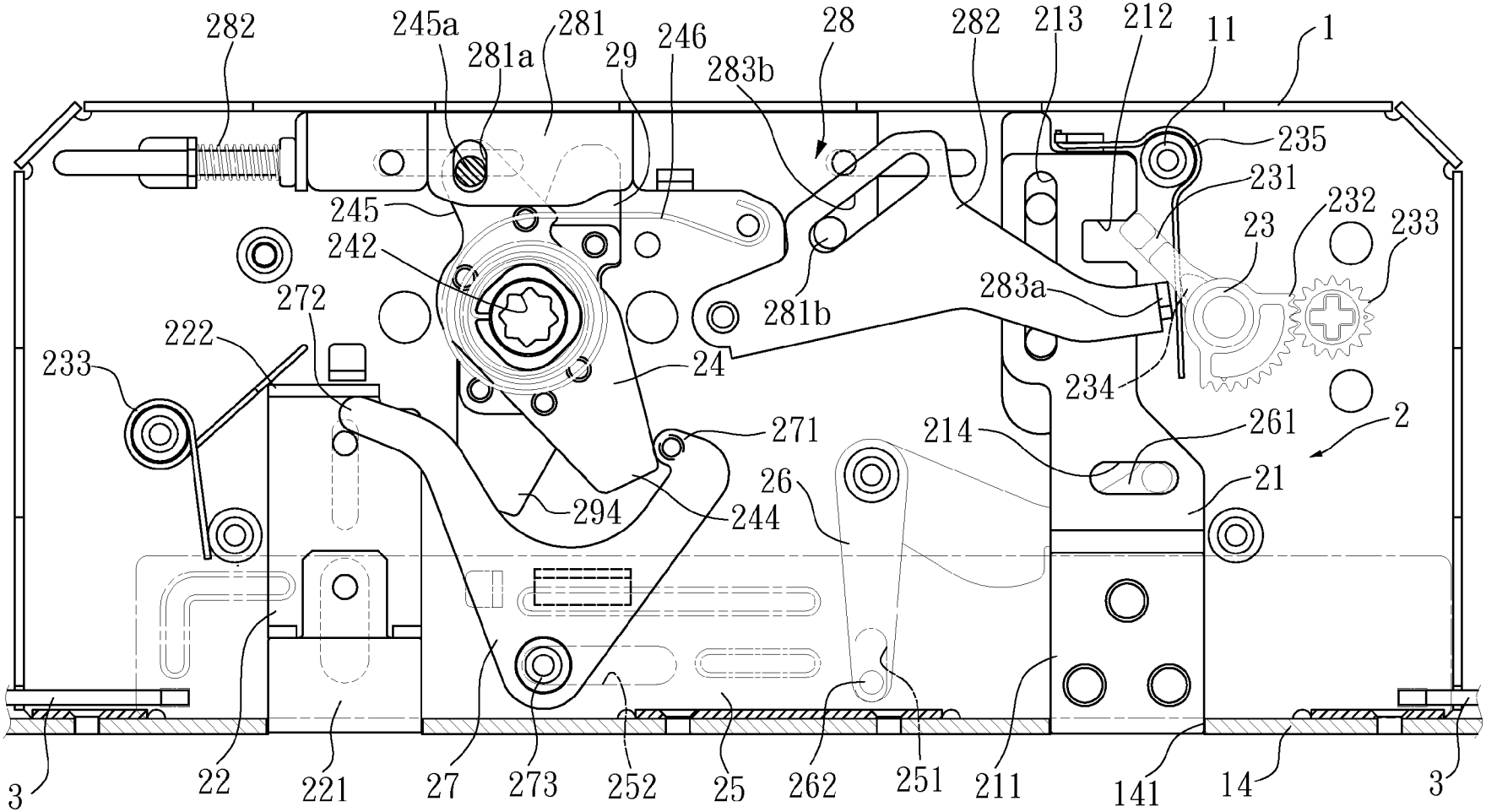
FIG. 4 is a schematic planar view of a primary lock assembly of the present invention.
Figure 5:
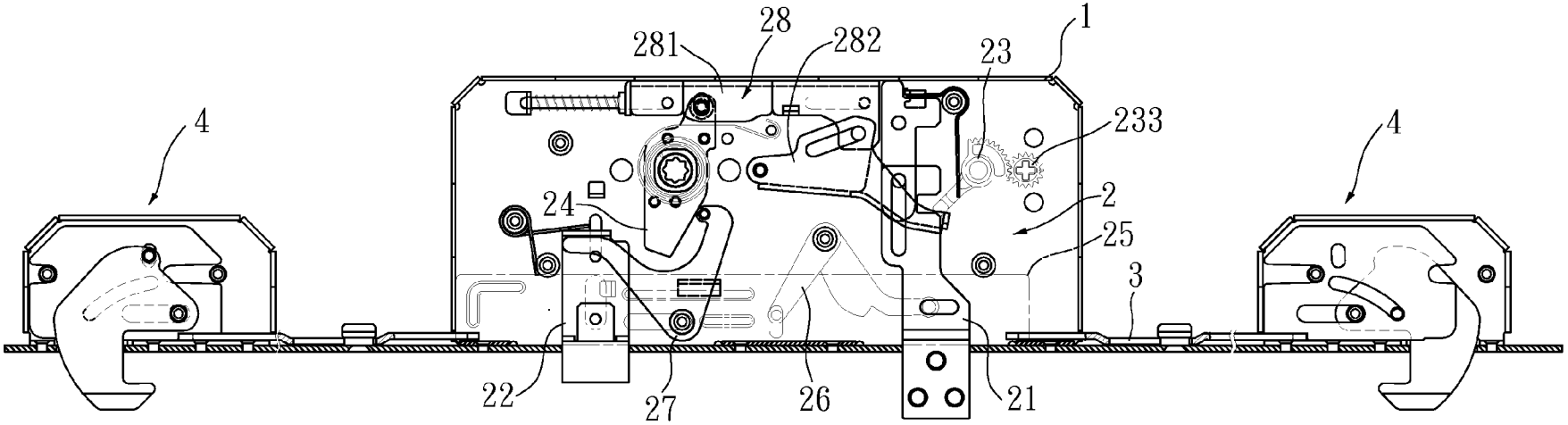
FIG. 5 is a schematic view of a door lock when locked in accordance with the present invention.
Figure 6:
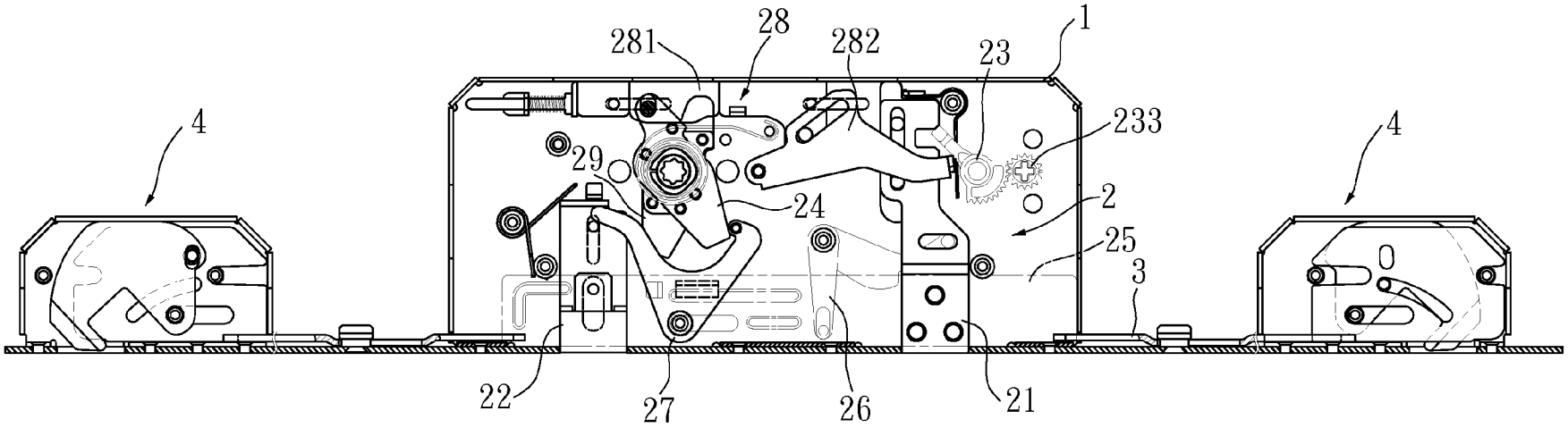
FIG. 6 is a schematic view of a door lock when unlocked in accordance with the present invention.
Figure 7:
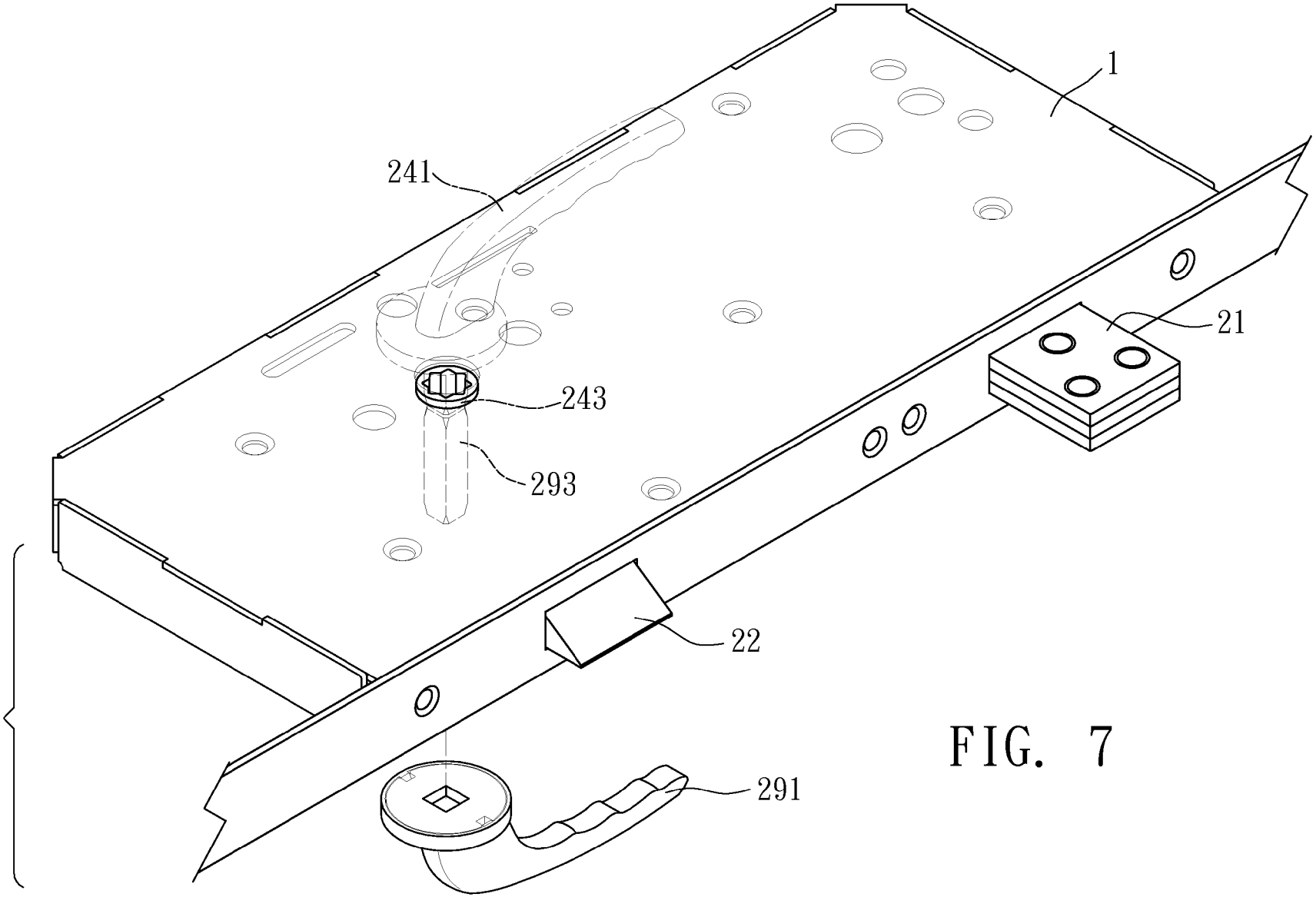
FIG. 7 is a schematic view of a door handle and a coupling portion in accordance with the present invention.
Figure 8:
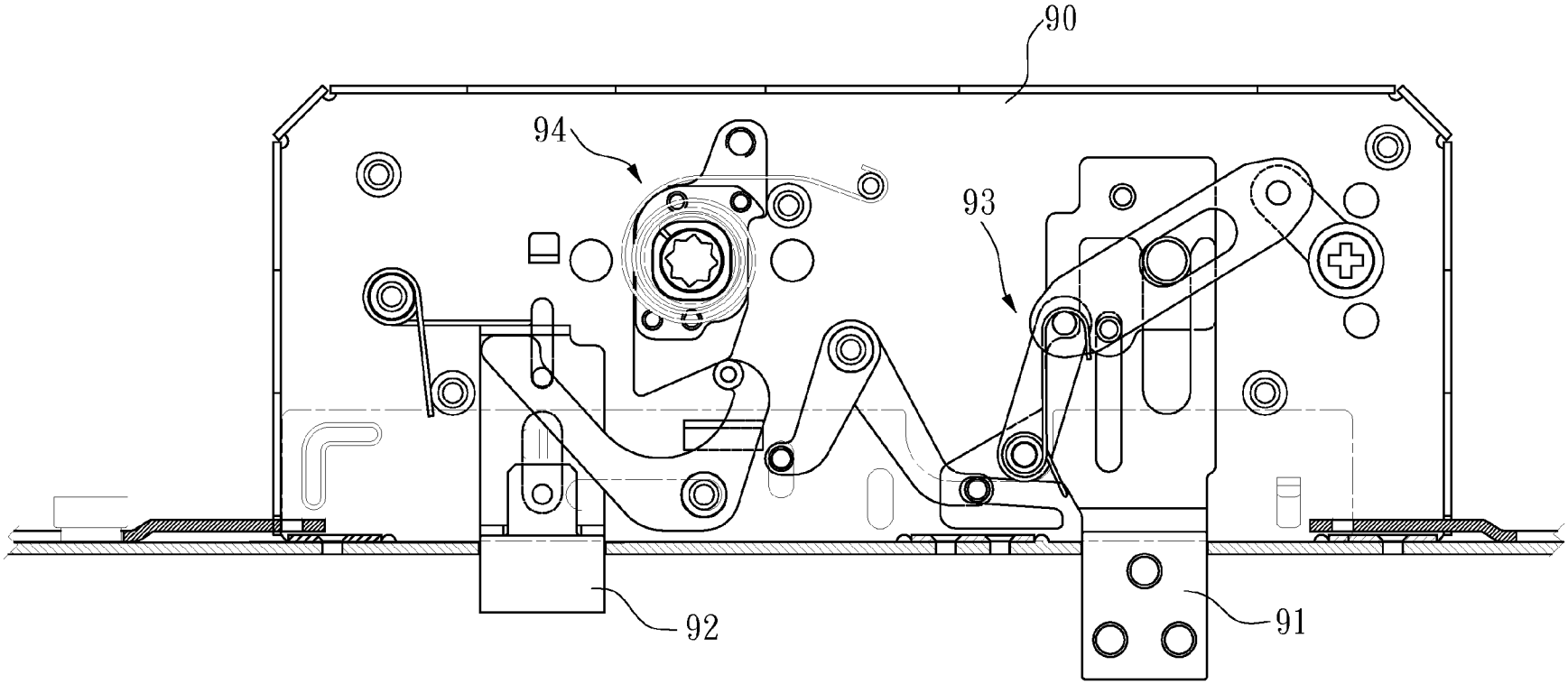
FIG. 8 PRIOR ART
FIG. 8 is a schematic planar view of a conventional door lock when locked.
Figure 9:
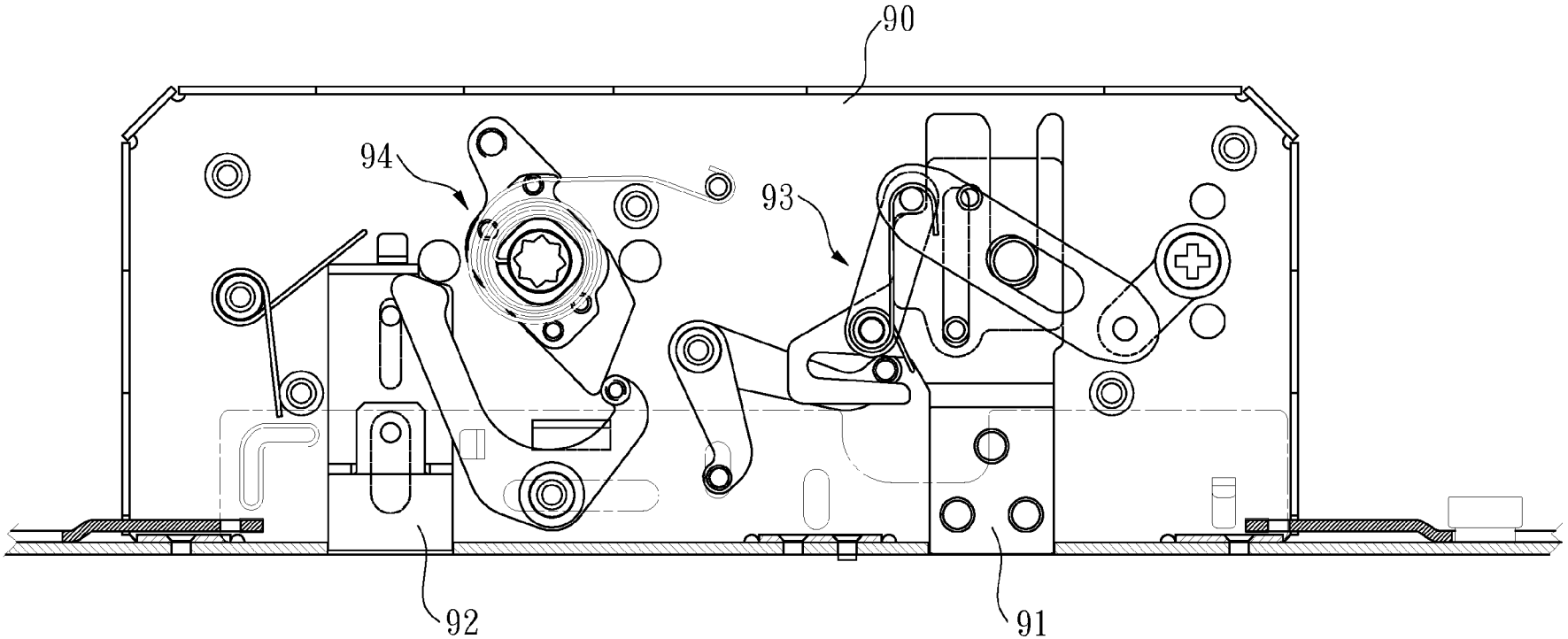
FIG. 9 PRIOR ART
FIG. 9 is a schematic planar view of a conventional door lock when unlocked.

This preferred embodiment provides a door lock transmission structure, comprising: a case 1, including a plurality of protruding pillars 11 and through holes 12 for installing a primary lock assembly 2 (wherein the case 1 of this preferred embodiment as shown in the figures further comprises components such as a cover 13 secured onto the case 1 by screws and a side panel 14 installed on a side of a door), and the primary lock assembly 2 including a link rod 3 installed at upper and lower position of the door for driving a secondary lock assembly 4, and the primary lock assembly 2 comprises the following elements:

A first insert 21 and a second insert 22 are movably installed in the case 1, and each insert 21, 22 has a latch portion 211, 221 disposed at an end of the insert 21, 22 for passing out of the case 1 during an operation, and the case 1 as shown in FIG. 4 has a through hole 141 (disposed on the side panel 14 as shown in the figure) disposed at a position opposite to the latch portion 211, 221, and the latch portions 211, 221 of the first insert 21 and the second insert 22 are passed and limited into the through hole 141, so that the first insert 21 and the second insert 22 can slide in a direction towards the through hole 141 only, and when each latch portion 211, 221 as shown in FIG. 5 is extended, the door lock is situated at a locked status; on the other and, when the latch portions 211, 221 are retracted as shown in FIG. 6, the door lock is situated at an unlocked status.

The case 1 includes a swaying element 23 for driving the first insert 21 to slide. In this preferred embodiment, the first insert 21 includes a notch 212 in the case 1, and the notch 212 is opened towards the first insert 21, and the swaying element 23 includes a turning rod 231 embedded into the 之 notch 212 of the first insert 21, and the swaying element 23 includes a guiding gear 232 installed at an opposite side of the turning rod 231 for engaging the guiding gear 232 with a driving gear 233, such that the driving gear 233 can be turned to pivotally sway the swaying element 23. Unlike the way of driving by the link rod in a conventional door lock, this preferred embodiment of the invention can provide a power-saving transmission structure having the driving gear 233 engaged with the guiding gear 232.

In addition, the swaying element 23 as shown in FIG. 4 includes a protrusion 234 extended towards the pivotal connection position of the turning rod 231, and case 1 includes a power-saving spring 235 pressed against the protrusion 234, such that when the swaying element 23 is swayed, the pressing of the power-saving spring 235 provides a force applied towards the rotating direction, and further improves the power-saving effect.

The second insert 22 includes a stop wall 222 inside the case 1 and installed at an end of the second insert 22. In this preferred embodiment, the case 1 includes a torque spring 223, and an end presses against the protruding pillar 11 of the case 1, and another end presses against an external side of the stop wall 222. With the torque spring 223 pressing against the second insert 22, the latch portion 221 can be passed downwardly out from the through hole 141 of the case 1 in a normal condition.

In this preferred embodiment, the first insert 21 inside the case 1 includes a first slot 213 opened in the same sliding direction of the first insert 21, a protruding pillar 11 disposed in the case 1 and at a position corresponding to the first slot 213, and the first insert 21 is sheathed to the protruding pillar 11 through the first slot 213 for limiting the sliding path of the first insert 21.

In two driving elements 24, 29, one of the driving elements 24 is coupled to a door handle 241 installed behind a door, and the driving element 29 is coupled to another door handle 291 on the front side of the door. The two driving elements 24, 29 are stacked inside the case 1, and the driving element 24 drives the door handle 241 from an internal side of the door, and door handle 291 is driven by the driving element 29 from the front side of the door. The driving element 24 includes an insert hole 242 disposed axially on both ends and provided for installing a coupling portion 243 of the door handle 241, a first turning end 244 disposed on the same side of an end of the driving element 24 for driving the second insert 22 to slide, wherein another end of the driving element 24 coupled to the door handle 241 behind the door includes a second turning end 245 for linking the second insert 22 and the first insert 21. The driving element 29 includes an insert hole 292 coaxially disposed between both ends and provided for installing the coupling portion 293 of the door handle 291, and a first turning end 294 disposed on the same side of an end of the driving element 29 for driving the second insert 22 to slide.

In this preferred embodiment, each of the coupling portion 243 of the door handle 241 and the coupling portion 293 of the door handle 291 includes two rods pivotally coupled to their distal ends, and each rod corresponds to the insert hole 242 of the driving element 24 and the insert hole 292 of the driving element 29, wherein the two rods are in quadrilateral shape, and the insert holes 242, 292 are provided for installing the rods in a plum blossom shape.

The driving element 24 includes a spiral torque spring 246 installed thereon, and the driving element 29 includes a spiral torque spring 295, and these two spiral torque springs 246, 295 are provided for resuming the original positions of the driving element 24 and the driving element 29 respectively after an operation takes place, and the spiral torque spring 246 is sheathed around the insert hole 242, and the spiral torque spring 295 is sheathed around the insert hole 292, such that after the driving elements 24, 29 are operated, the resilience of the spiral torque spring 246, 295 drive them to resume their original positions.

A plate 25 is provided for lining the first insert 21 and the two secondary lock assemblies 4 for a synchronous movement, and a link rod 3 is connected between both ends of the plate 25 and the two secondary lock assemblies 4. In addition, the case 1 further includes a first link element 26 slid together with the first insert 21 for a pivotal swing and driving the plate 25 to slide.

In this preferred embodiment, the first insert 21 includes a second slot 214 disposed between both ends of the first insert 21, and the second slot 214 is opened in a direction perpendicular to the open direction of the first slot 213, and an end of the first link element 26 has a drag portion 261, for protruding the first link element 26 from the second slot 214, such that when the first insert 21 slides, the first link element 26 is driven to swing pivotally. The plate 25 includes a third slot 251 installed in the same direction of the first slot 213. Further, the first link element 26 includes a guiding pillar 262 protruded from the third slot 251 and provided for driving the plate 25 to slide when the first link element 26 is swung pivotally, so as to drive the two secondary lock assemblies 4 to lock or unlock the door.

A second link element 27 is moved together with the driving elements 24, 29 to drive the second insert 22 to slide. The second link element 27 includes a first abutting portion 271 and a second abutting portion 272, and the first abutting portion 271 is provided for abutting against the first turning ends 244, 294 of the two driving elements 24, 29. When the first turning ends 244, 294 are turned, the second link element 27 is linked to swing. The second abutting portion 272 is provided for abutting against an internal side of the stop wall 222 of the second insert 22, such that when the second link element 27 is swung, the second insert 22 is driven to retract.

In addition, a stop pillar 273 is protruded from the pivotal connection position of the second link element 27 and the case 1, and the plate 25 includes a fourth slot 252 disposed at a corresponding position of the stop pillar 273, and the plate 25 is sheathed onto the stop pillar 273 through the fourth slot 252 for limiting the sliding path of the plate 25.

A link component 28 is provided for linking the first insert 21 and the second insert 22 for a synchronous movement, and the link component 28 includes a sliding element 281, and a portion between both ends are coupled with the second turning end 245 of the driving element 24, and an end of the sliding element 281 has a spring 282 for resuming the original position of the sliding element 281 after the sliding element 281 is moved, and another end of the sliding element 281 is connected to a swaying element 283 for linking the latch portion 211 of the first insert 21 to retract, and an end of the swaying element 283 has a poking portion 283*a* for driving the turning rod 231 of the swaying element 23 to swing.

In this preferred embodiment, the second turning end 245 of the driving element 24 includes a screw 245*a* secured to the end of the second turning end 245, and the sliding element 281 includes a through hole 281 disposed at an opposite position, and the screw 245*a* is partially passed through and extended into the through hole 281*a*.

The swaying element 283 includes a rectangular hole 283*b* formed between the poking portion 283*a* and the pivotal connecting end, and a guiding pillar 281*b* disposed at the end of the sliding element 281, and the sliding element 281 is protruded from the rectangular hole 283*b* through the guiding pillar 281*b*, such that when the sliding element 281 slides sideway, the guiding pillar 281*b* drives the swaying element 283 to swing.

In FIG. 4, when the driving element 24 is driven by the door handle 241 to rotate, the second turning end 245 of the driving element 24 props the sliding element 281 to a sidewall inside the through hole 281*a* by the screw 245*a*, such that the sliding element 281 slides to the left side as shown in the figure. Now, the poking portion 283*a* of the swaying element 283 pokes the turning rod 231 of the swaying element 23 to sway upward. Since the turning rod 231 is situated in the notch 212 of the first insert 21, therefore the upwardly swung turning rod 231 drives the first insert 21 to retract into the case 1. If the door handle 241 is released, the sliding element 281 will resume its original position by the resilience of the spring 282. Now, the swaying element 283 no longer props the turning rod 231 anymore, so that the first insert 21 can be pushed downward by the power-saving spring 235 and extended out from the case 1.

From the description of the preferred embodiment above, we can observe the advantages of the invention easily. If a user wants to open the first insert 21 from the front side of the door, the user has to use a key to open the lock. Unlike the conventional door lock, the door handle 241 installed behind the door in accordance with the invention can be turned to open the first insert 21, the second insert 22 and the two secondary lock assemblies 4 of the primary lock assembly 2 simultaneously. Besides the anti-burglar effect, users can open the door lock behind the door simply by turning the door handle 241 behind the door without requiring two necessary steps of the conventional door lock. For an emergency like a fire, users can turn the door handle 241 to escape immediately. Compared with the conventional door lock, the invention provides more time for the escape, and thus the door lock of the present invention obviously provides a convenient way of unlocking the door lock and offers a better safety to users.

It is noteworthy to point out that the primary lock assembly 2 of the present invention further includes a power-saving mechanism to make the operation of locking and unlocking the door lock easier.

In summation of the description above, the present invention definitely achieves the expected objectives and complies with the patent application requirements, and thus is duly filed for patent application.

While the invention has been described by means of specific embodiments, numerous modifications and variations could be made thereto by those skilled in the art without departing from the scope and spirit of the invention set forth in the claims.

What is claimed is:

1. A door lock transmission structure, comprising:

a case, including a plurality of protruding pillars and through holes for assembling a primary lock assembly, and the primary lock assembly being provided for driving a secondary lock assembly by a link rod installed separately at the top and the bottom of a door, and the primary lock assembly comprising:

a first insert and a second insert, both being movably installed in the case, the first insert includes a first slot disposed in the case and along its sliding direction a protruding pillar disposed at the case and corresponding to the first slot, such that the first insert can be sheathed to the protruding pillar through the first slot, for limiting the sliding path of the first insert, the first insert includes another second slot disposed between both ends of the first insert and in a direction perpendicular to the first slot, and the first link element includes a drag portion disposed at an end of the first link element and protruded from the second slot, and the plate includes a third slot disposed in the same direction of the first slot, and the first link element includes a guiding pillar protruded from the third slot and each insert having a latch portion disposed at an end of each insert and penetrated through the case, and the case having a turning element for driving the first insert to slide, and the second insert in the case having a stop wall disposed at an end of the second insert;

two driving elements, driven by a door handle, and stacked in the case, and operated independently, and having an insert hole disposed coaxially between both ends of the two driving elements for receiving a coupling portion of a door handle and driven by the driving elements, and a first turning end disposed on the same end of the driving element for driving the second insert to slide, and a second turning end being disposed at another end of the driving element coupled to the door handle of the door for linking the first insert to operate;

a plate, linked with the first insert and operated synchronously with the two secondary lock assemblies, and the link rod being coupled between both ends of the plate and the two secondary lock assemblies, and a first link element sliding together with the first insert and pivotally swayed and dragged to slide the plate;

a second link element, operated together with the driving element for dragging the second insert to slide, and having a first abutting portion abutted against an internal side of the stop wall of the second insert, and a second abutting portion abutted against the first turning end of the two driving elements;

a link component, linked and operated synchronously with the first insert and the second insert, and including a sliding element disposed between both ends of the link component and coupled to the second turning end of the driving element, a spring installed at an end of the sliding element for restoring a position after the sliding element is turned, a swaying element installed at another end of the sliding element for linking and retracting the latch portion of the first insert, and a poking portion disposed at an end for dragging the turning element to sway.

2. The door lock transmission structure of claim 1, wherein the second link element includes a stop pillar protruded from a pivoting position of the second link element, and the plate includes a fourth slot disposed at a position corresponding to the stop pillar and sheathed to the stop pillar for sliding the limit plate along a sliding path.

3. The door lock transmission structure of claim 1, wherein the swaying element includes a rectangular hole disposed between the poking portion and a pivoting end, and a guiding pillar disposed at the end having the sliding element and protruded from the rectangular hole.

4. The door lock transmission structure of claim 1, wherein the first insert includes a notch disposed in the case and along a lateral direction of the first insert, and the turning element includes a turning rod embedded into the notch of the first insert, and a guiding gear engaged with a driving gear for pivotally swaying the turning element.

5. The door lock transmission structure of claim 4, wherein the turning element has a protrusion extended from the pivoting position in a direction towards the turning rod, and the case includes a power-saving spring abutted against the protrusion.

6. The door lock transmission structure of claim 1, wherein the driving element has a screw secured to and passed through the second turning end of the driving element, and the sliding element includes a through hole disposed at a corresponding position of the sliding element, and the screw is passed into and partially protruded from the through hole, for turning the sliding element to slide.

7. The door lock transmission structure of claim 1, wherein the coupling portion of the door handle includes two rods coaxially and pivotally coupled to the ends of the coupling portion, and each rod is aligned corresponding to an insert hole of each driving element.

8. The door lock transmission structure of claim 7, wherein the two rods are in a quadrilateral shape, and each insert hole is provided for inserting each corresponding rod into a plum blossom shape.

9. The door lock transmission structure of claim 1, wherein the case includes a torque spring with an end abutted against the protruding pillar of the case, and another end propped at an external side of the stop wall, and each driving element includes a spiral torque spring for restoring a position after the driving element is moved, and the spiral torque spring is sheathed around the insert hole, and an end of the external ring of each spiral torque spring is abutted against the protruding pillar in the case, and another end of the internal ring is coupled to the driving element.

* * * * *